US011457738B2

(12) United States Patent
Irgang et al.

(10) Patent No.: US 11,457,738 B2
(45) Date of Patent: Oct. 4, 2022

(54) DRAWER SIDE WALL

(71) Applicant: Julius Blum GmbH, Hoechst (AT)

(72) Inventors: Markus Irgang, Altach (AT); Markus Kampl, Dornbirn (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 16/939,461

(22) Filed: Jul. 27, 2020

(65) Prior Publication Data

US 2020/0352328 A1 Nov. 12, 2020

Related U.S. Application Data

(63) Continuation of application No. PCT/AT2019/060010, filed on Jan. 10, 2019.

(30) Foreign Application Priority Data

Feb. 1, 2018 (AT) ..... A 50102/2018

(51) Int. Cl.
*A47B 88/90* (2017.01)

(52) U.S. Cl.
CPC ..... *A47B 88/941* (2017.01); *A47B 2088/902* (2017.01)

(58) Field of Classification Search
CPC ..... A47B 88/941; A47B 2088/902; A47B 2210/02; A47B 88/956; A47B 88/427; A47B 88/90; A47B 88/95; A47B 47/0075; A47B 2088/94; A47B 2088/951; A47B 88/931; F16B 12/46; F16B 5/008; Y10T 403/4602
See application file for complete search history.

(56) References Cited

U.S. PATENT DOCUMENTS 3,416,850 A 12/1968 Hilfinger et al.
4,752,150 A * 6/1988 Salice ..... F16B 12/26 403/330
5,213,403 A * 5/1993 Lautenschlager .... A47B 88/427 312/140
5,540,515 A * 7/1996 Rock ..... A47B 88/95 292/341.17
5,564,807 A * 10/1996 Rock ..... A47B 88/467 312/331
5,971,516 A * 10/1999 Huber ..... A47B 88/941 312/348.1

(Continued)

FOREIGN PATENT DOCUMENTS

AT 510 724 6/2012
AT 510 774 6/2012

(Continued)

OTHER PUBLICATIONS

International Search Report dated Mar. 14, 2019 in International (PCT) Application No. PCT/AT2019/060010.

*Primary Examiner* — Hiwot E Tefera
(74) *Attorney, Agent, or Firm* — Wenderoth, Lind & Ponack, L.L.P.

(57) ABSTRACT

A drawer sidewall includes a carrier body, a sidewall profile, and a holding device for fastening a drawer rear wall. Each of the sidewall profile and the holding device is fixed to the carrier body, and the holding device, at least in an unfixed condition of the drawer rear wall, is aligned inclined relative to a longitudinal direction of the carrier body.

17 Claims, 7 Drawing Sheets

(56) References Cited

U.S. PATENT DOCUMENTS

| | | | | |
|---|---|---|---|---|
| 6,412,893 | B1 * | 7/2002 | Muterthies | A47B 88/941 312/330.1 |
| 8,998,356 | B2 | 4/2015 | Gasser | |
| 9,028,019 | B2 * | 5/2015 | Holzapfel | A47B 88/95 312/348.4 |
| 9,033,436 | B2 * | 5/2015 | Holzapfel | A47B 88/95 312/348.4 |
| 9,039,108 | B2 | 5/2015 | Feuerstein | |
| 10,376,053 | B2 | 8/2019 | Schallert | |
| 10,557,491 | B2 | 2/2020 | Schön | |
| 10,772,422 | B1 * | 9/2020 | Chen | F16B 12/26 |
| 2004/0000852 | A1 * | 1/2004 | Lam Harn | A47B 88/956 312/348.4 |
| 2008/0315740 | A1 * | 12/2008 | Lam | A47B 88/941 312/334.1 |
| 2010/0102692 | A1 * | 4/2010 | Hammerle | A47B 88/956 312/348.4 |
| 2013/0049560 | A1 | 2/2013 | Liu | |
| 2013/0257251 | A1 * | 10/2013 | Gasser | F16B 12/26 312/348.2 |
| 2014/0015391 | A1 | 1/2014 | Feuerstein | |
| 2014/0167586 | A1 | 6/2014 | Schallert | |
| 2018/0017091 | A1 * | 1/2018 | Schön | F16B 12/46 |

FOREIGN PATENT DOCUMENTS

| | | | | |
|---|---|---|---|---|
| CN | 1853530 | | 11/2006 | |
| CN | 103228178 | | 7/2013 | |
| CN | 204273794 | | 4/2015 | |
| CN | 204444901 | | 7/2015 | |
| DE | 32 18 504 | | 12/1982 | |
| DE | 20 2010 007 427 | | 10/2011 | |
| EP | 3009693 | A1 * | 4/2016 | F16B 12/20 |
| FR | 1 378 237 | | 11/1964 | |
| FR | 2 505 635 | | 11/1982 | |
| JP | 2014-503238 | | 2/2014 | |
| JP | 2014-529447 | | 11/2014 | |
| WO | 2012/068604 | | 5/2012 | |
| WO | 2012/142630 | | 10/2012 | |
| WO | 2013/029067 | | 3/2013 | |

* cited by examiner

DRAWER SIDE WALL

BACKGROUND OF THE INVENTION

The present invention relates to a drawer sidewall comprising a carrier body, a sidewall profile, and a holding device for fastening a drawer rear wall, and each of the sidewall profile and the holding device is fixed to the carrier body. The invention further relates to an arrangement comprising at least such a drawer sidewall and a drawer rear wall which is fixed to the holding device.

Such drawer sidewalls, also in combination with a drawer rear wall, are well-known according to the prior art.

A problem which arises especially with large constructional heights is that a gap is formed in the region of the connection between a drawer sidewall and a drawer rear wall. By the end user, that gap is considered to be disturbing for aesthetic reasons, and particularly the more the gap is arranged higher in relation to the carrier body.

SUMMARY OF THE INVENTION

The object of the present invention is to at least partially avoid the aforesaid problem and to propose, compared to the prior art, an improved drawer sidewall and arrangement, respectively, having such an improved drawer sidewall.

With the drawer sidewall, it is provided according to the invention that the holding device, at least in an unfixed condition of the drawer rear wall, is aligned inclined relative to a longitudinal direction of the carrier body.

By this measure, it is possible that a drawer rear wall, which is fixed to the holding device, can be acted upon by a pre-tension in relation to the drawer sidewall. Thus, it can be ensured that the drawer rear wall, at least in the upper connecting region spaced from the carrier body, bears against the drawer sidewall in a gap-free manner.

It has thereby proven to be advantageous that the holding device, at least in the unfixed condition of the drawer rear wall, has a first angle smaller than 90°, preferably an angle larger than 85° and smaller than 90°, particularly preferred an angle of approximately 89.5°, relative to the longitudinal direction of the carrier body.

It has further proven to be advantageous that the sidewall profile includes at least one abutment portion on which the drawer sidewall can be supported. Thereby, the at least one abutment portion can be aligned perpendicular to the longitudinal direction of the carrier body, and/or can include a first region and a second region, wherein the first region has a smaller distance to the carrier body than the second region. The drawer rear wall, in a condition fixed to the holding device, bears at least against the second region of the abutment portion, and it is preferably provided that the drawer rear wall is spaced from the first region by a gap. In the best case, the drawer rear wall, in fact, bears against the drawer sidewall over its entire length in a gap-free manner. However, in particular with larger constructional heights, it cannot always be prevented that there is a minor gap present in the first region. However, this minor gap, in comparison with a gap in the second region, can be tolerated.

With the arrangement comprising at least one drawer sidewall according to the invention and a drawer rear wall which is fixed to the holding device, a particularly advantageous embodiment provides that the holding device, in the fixed condition of the drawer rear wall, has a larger angle to the longitudinal direction of the carrier body than in the unfixed condition of the drawer rear wall.

BRIEF DESCRIPTION OF THE DRAWINGS

Further details and advantages of the invention will be explained in the following with the aid of the description of figures and with reference to the drawings, in which.

DETAILED DESCRIPTION OF THE INVENTION

Figure 1:
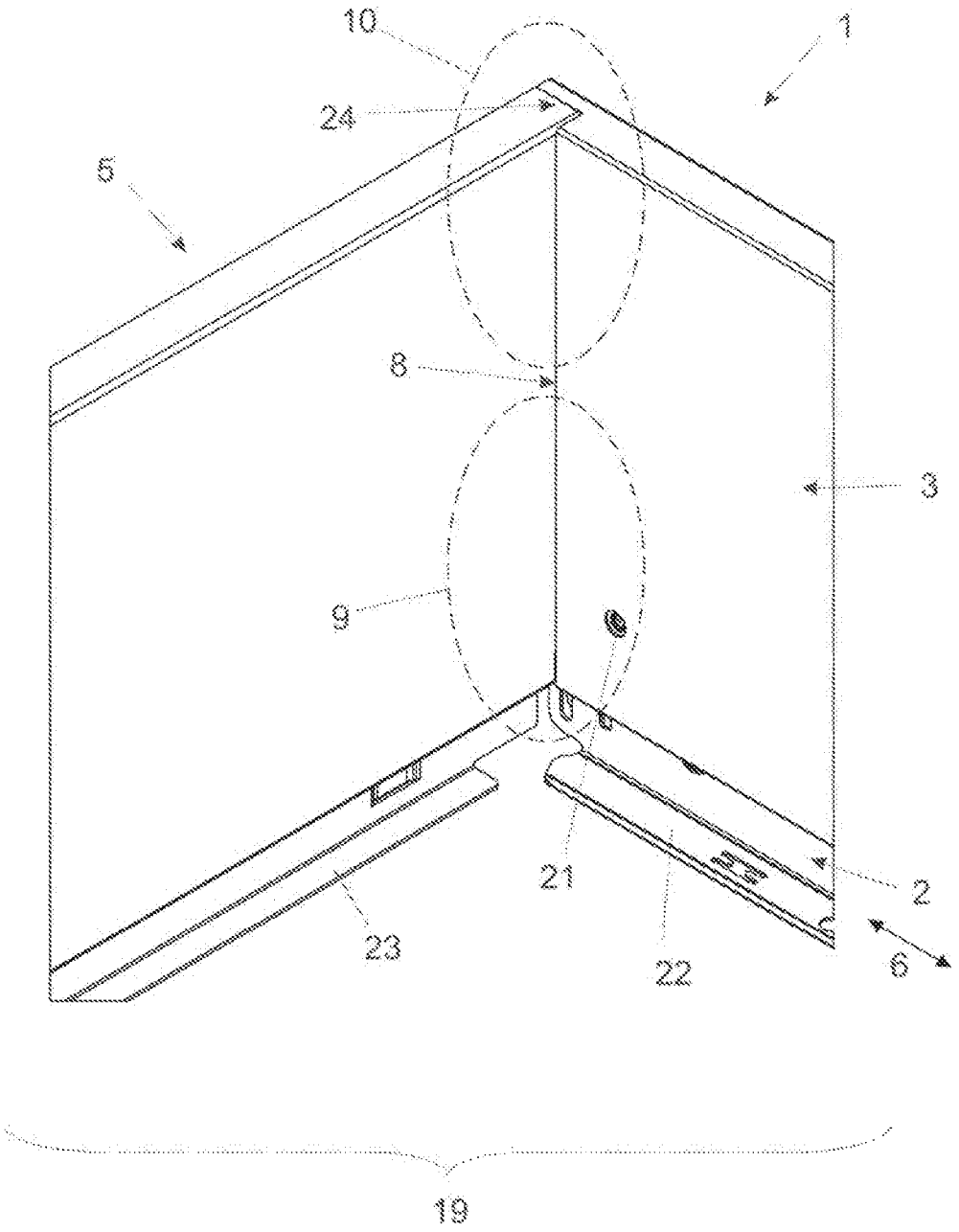
FIG. 1 shows a detail of an arrangement including a drawer sidewall and a drawer rear wall in a perspective view.

FIG. 1 shows a detail of an arrangement 19 including a drawer sidewall 1 and a drawer rear wall 5, seen from the interior of a drawer which is assembled with the aid of the arrangement 19.

The drawer sidewall 1 includes a carrier body 2, a sidewall profile 3 and a holding device 4 for fastening a drawer rear wall 5, and each of the sidewall profile 3 and the holding device 4 are fixed to the carrier body 2 (see also the following figures).

In the depicted case, the drawer rear wall 5 is fixed to the holding device 4.

The sidewall profile 3 includes an abutment portion 8 on which the drawer rear wall 5 is supported. The abutment portion 8 is aligned perpendicular to the longitudinal direction 6 of the carrier body 2. The abutment portion 8 is arranged on a front face of the drawer sidewall 1 on the sidewall profile 3, the front face facing towards the drawer rear wall 5.

The abutment portion 8 has a first region 9 and a second region 10, and the first region 9 has a smaller distance to (is closer to) the carrier body 2 than the second region 10. The drawer rear wall 5, in a condition fixed to the holding device 4, bears against at least the second region 10 of the abutment portion 8. At the same time, the drawer rear wall 5, depending on the configuration, can be spaced from the first region 9 by a gap 11 (see also FIG. 6), and the drawer rear wall 5, in the ideal case, also bears against the abutment portion 8 of the sidewall profile 3 in a gap-free manner.

The sidewall profile 3 includes a recess 24 in which the drawer rear wall 5, in a condition fixed to the holding device 4, is partially arranged.

The sidewall profile 3 includes an opening for an actuating element 21, and the actuating element 21 is coupled to a device for adjusting the inclination of the drawer in relation to pull-out guides which are fixed or which are configured to be fixed on both sides of the drawer.

Each of the drawer sidewall 1 and the drawer rear wall 5 includes a supporting limb 22, 23 for a drawer bottom.

The carrier body 2 may be configured as a rail-shaped profile which is partially configured as a "U" in a cross-section.

Figure 2A:
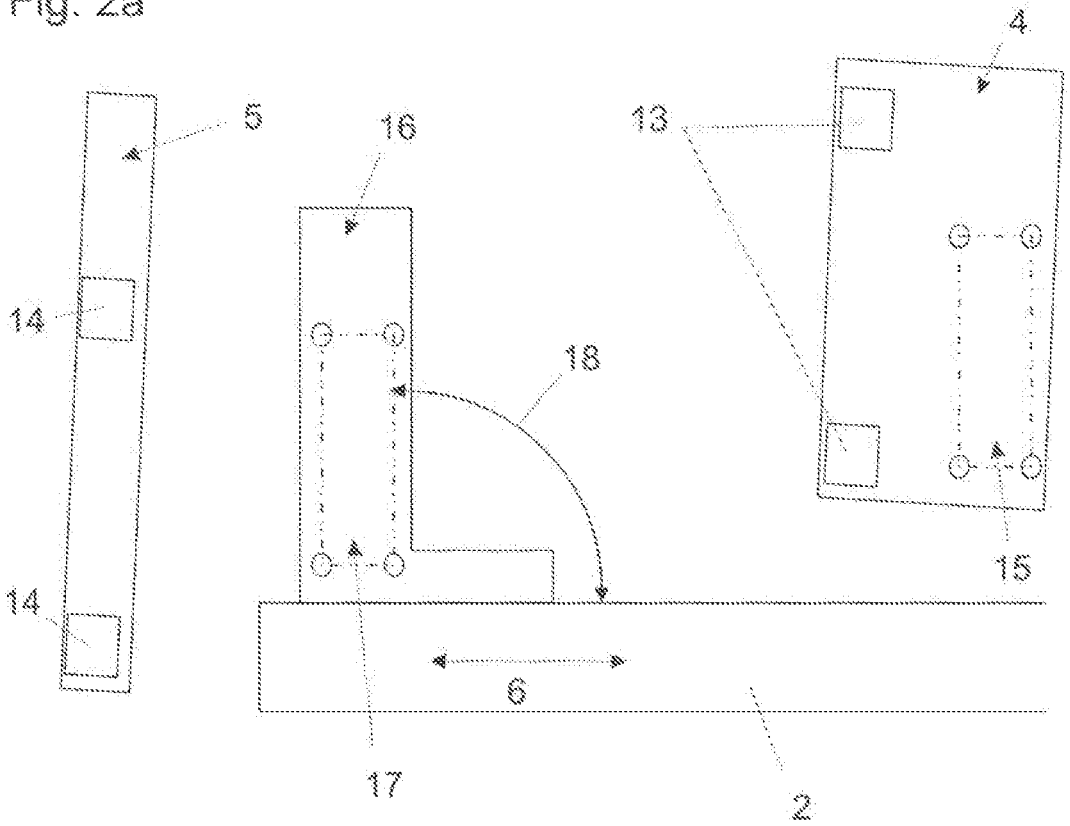
FIG. 2*a* is a schematically depicted side view of an arrangement including a drawer rear wall, a carrier body and a holding device in an unconnected condition.

FIG. 2*a* shows an arrangement comprising a drawer rear wall 5, a carrier body 2 and a holding device 4 in an unconnected condition.

The holding device 4 includes first portions 13 of a locking device for engaging second portions 14 of the locking device, the second portions 14 being arranged on the drawer rear wall 5 and being configured to co-operate with the first portions 13. The first portions 13 and the second portions 14 jointly form fastening locations 12 for releasably fastening the drawer rear wall 5 to the holding device 4.

The holding device 4 includes a holding device interface 15 for fastening to the carrier body 2.

The holding device 4 is substantially made of a plastic material.

A fastening device 16 is provided by which the holding device 4 can be fixed to the carrier body 2. The fastening device 16 is welded to the carrier body 2. The fastening device 16 is substantially made of a metallic material.

Figure 2B:
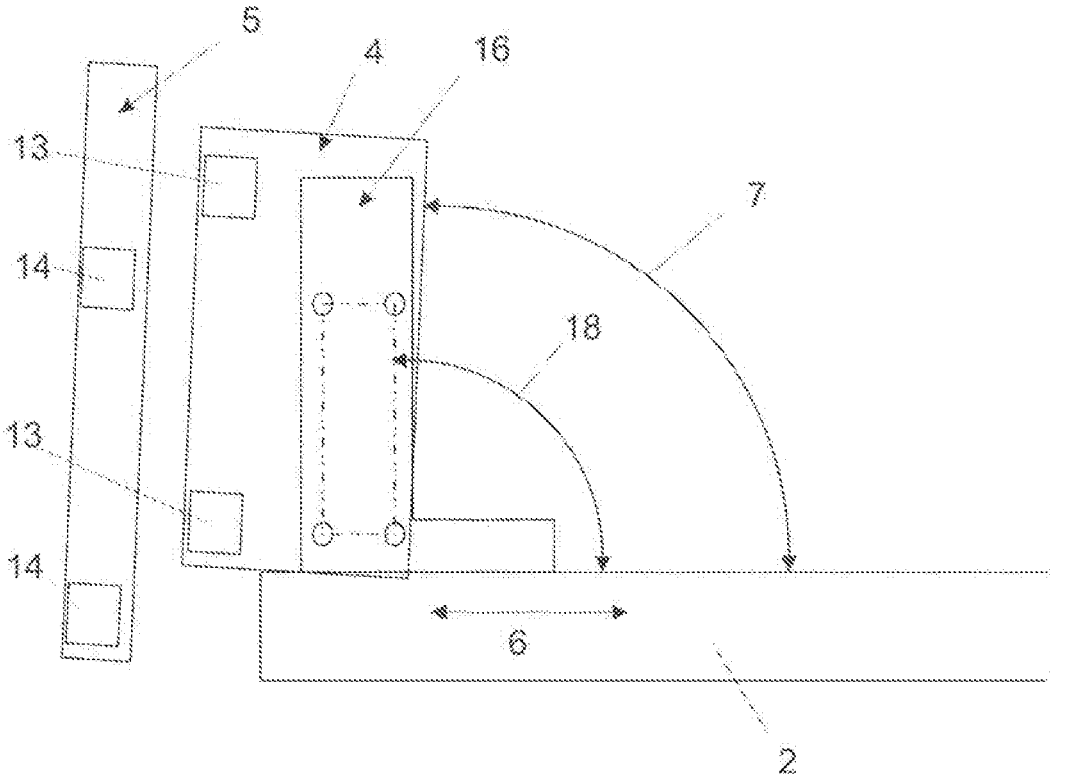
FIG. 2*b* shows the arrangement according to FIG. 2*a*, in which the holding device is fixed to the carrier body.

The fastening device 16 includes a fastening device interface 17 for connecting the holding device 4 to the fastening device 16. The fastening device interface 17 has an angle 18 of 90° to the longitudinal direction 6 of the carrier body 2 within the plane of the drawer sidewall 1 as indicated in FIGS. 2*a* and 2*b*. Preferably, the entire fastening device 16 has an angle of 90° to the longitudinal direction 6 of the carrier body 2.

Instead of an indirect fastening via the fastening device 16, the holding device 4 can also be directly fixed to the carrier body 2. In such a case, the fastening device 16 can be omitted.

FIG. 2*b* shows the arrangement described in connection with FIG. 2*a*, in which the holding device 4 is fixed to the carrier body 2 via the fastening device 16.

Figure 2C:
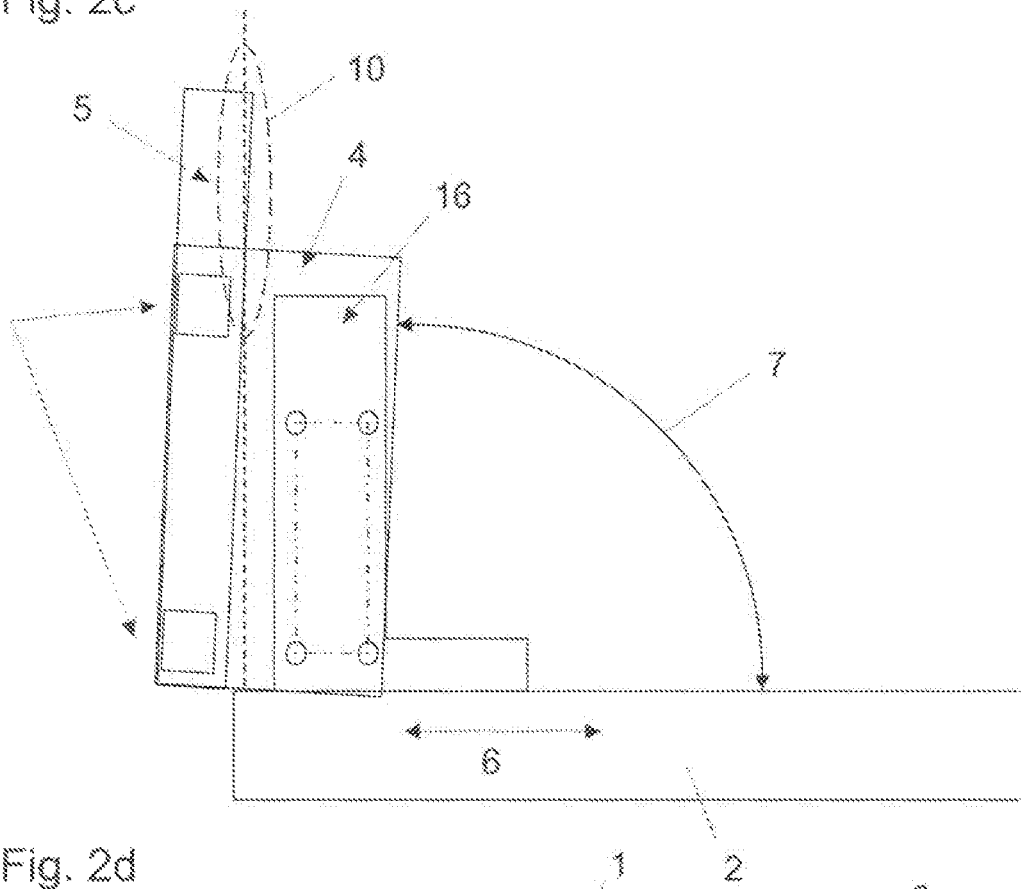
FIG. 2*c* shows the arrangement according to FIG. 2*b*, in which the drawer rear wall is additionally fixed to the holding device.

The holding device 4, at least in the unfixed condition of the drawer rear wall 5, is aligned at an incline relative to a longitudinal direction 6 of the carrier body 2 within the plane of the drawer sidewall 1 as indicated in at least FIG. 2*c*. Thereby, the holding device 4 has a first angle 7 of approximately 89.5° relative to the longitudinal direction 6 of the carrier body 2. This means that the holding device 4 is slightly inclinedly relative to the perpendicular in a direction of the carrier body 2 (within a plane of the drawer sidewall 1).

This inclined position of the holding device 4 can also be obtained when the holding device 4 is directly fixed to the carrier body 2.

FIG. 2*c* shows the arrangement described in connection with FIGS. 2*a* and 2*b*, in which the drawer rear wall 5 is additionally fixed to the holding device 4 via the fastening locations 12. The drawer rear wall 5 is aligned in a parallel relationship to the holding device 4.

The position 35 of the abutment portion 8 of the sidewall profile 3 of the drawer sidewall 1 is depicted in a dashed line. As visible, the drawer rear wall 5, in the upper region 10, would protrude into the sidewall profile 3. However, this is only a theoretical installation situation which does not arise in reality because of the existence of the sidewall profile 3.

Figure 2D:
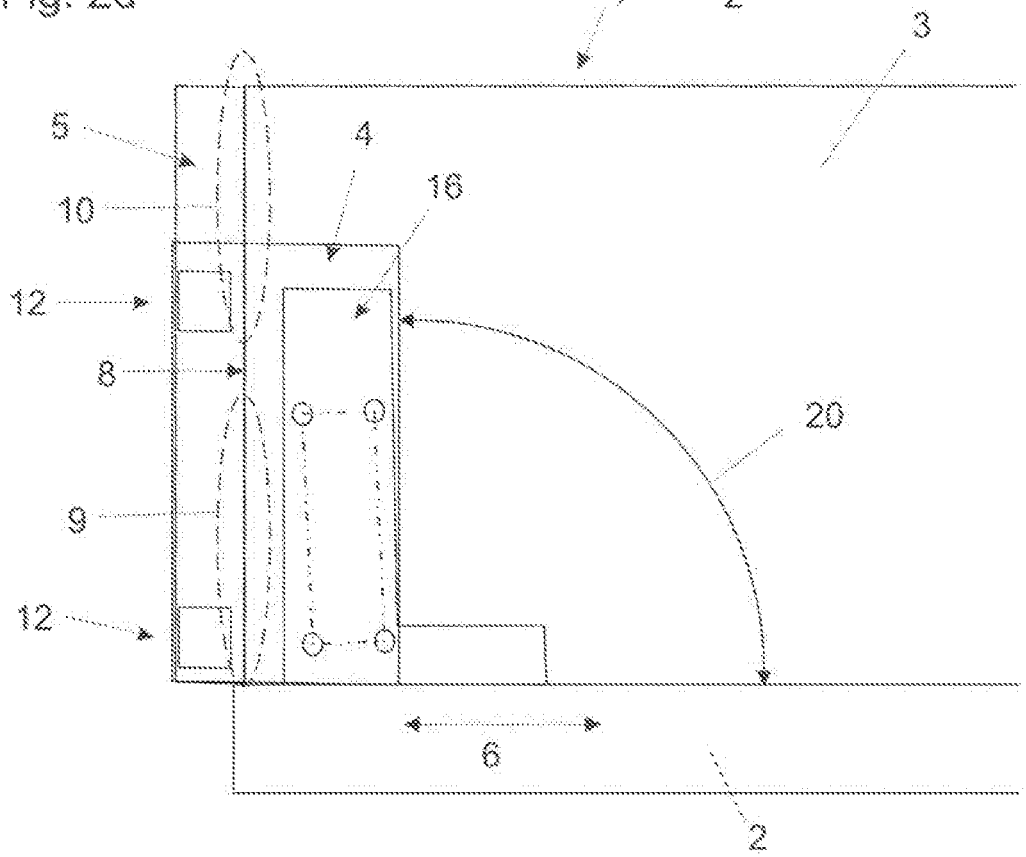
FIG. 2*d* shows the arrangement according to FIG. 2*c*, in which a sidewall profile is additionally arranged on the carrier body.

Instead, the drawer rear wall 5—as evident from a comparison with FIG. 2*d*—must yield because of the drawer rear wall 5 bearing against the sidewall profile 3. Thereby, the drawer rear wall 5 is aligned substantially parallel to the abutment portion 8 of the sidewall profile 3, or at least significantly reduces the theoretical inclined position of the drawer rear wall 5. The clearance required for the change in position is provided by the holding device 4, the fastening device 16 and the carrier body 6. The holding device 4, in a fixed condition of the drawer rear wall 5, forms a larger second angle 20 with respect to the longitudinal direction 6 of the carrier body 2 than in the unfixed condition of the drawer rear wall 5. Again, as shown in FIG. 2*d*, the second angle 20 with respect to the longitudinal direction 6 is within the plane of the drawer sidewall 1.

As a result, the drawer rear wall 5, in a condition fixed to the holding device 4, bears against the second region 10 in a gap-free manner, and—in the ideal case also on the first region 9—of the abutment portion 8. In this way, an aesthetically pleasing appearance of the drawer can be ensured in a region of the connection between the drawer rear wall 5 and the drawer sidewall 1.

Figure 3A:
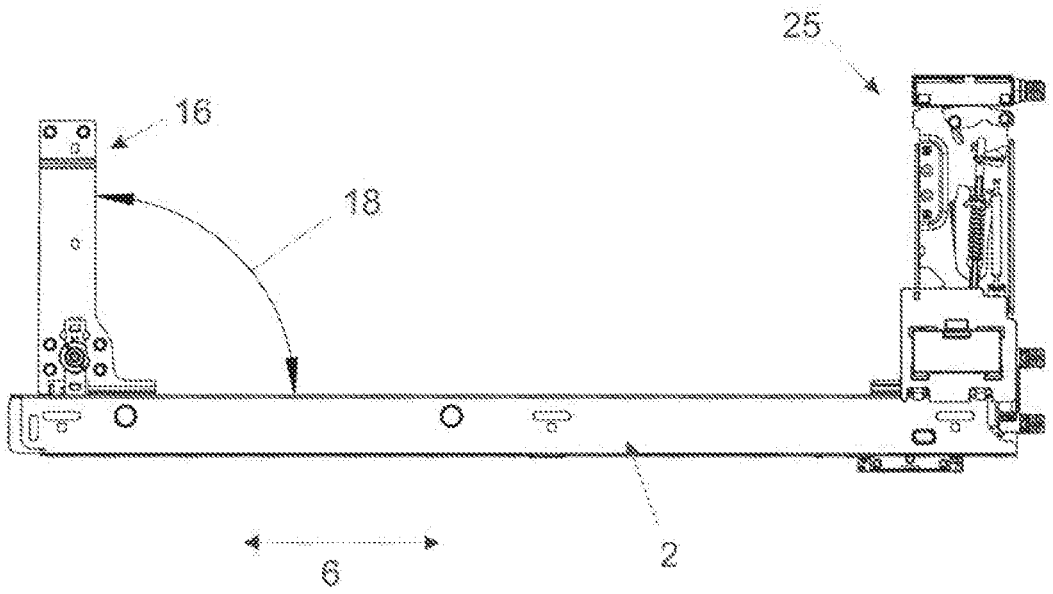
FIG. 3*a* is a side view of an arrangement including a carrier body and a fastening device for fastening a drawer front panel.

FIG. 3*a* shows a carrier body 2 on which a fastening device 16 is arranged, and by which the holding device 4 can be fixed to the carrier body 2. The fastening device 16 has an angle 18 of 90° to the longitudinal direction 6 of the carrier body 2.

The fastening device 16 is arranged in the rear region of the carrier body 2, the rear region facing towards (being closest to) the drawer rear wall 5. In the front region, facing towards a drawer front panel of the carrier body 2, a fastening device 25 for fixing a drawer front panel is arranged on the carrier body 2.

Figure 3B:
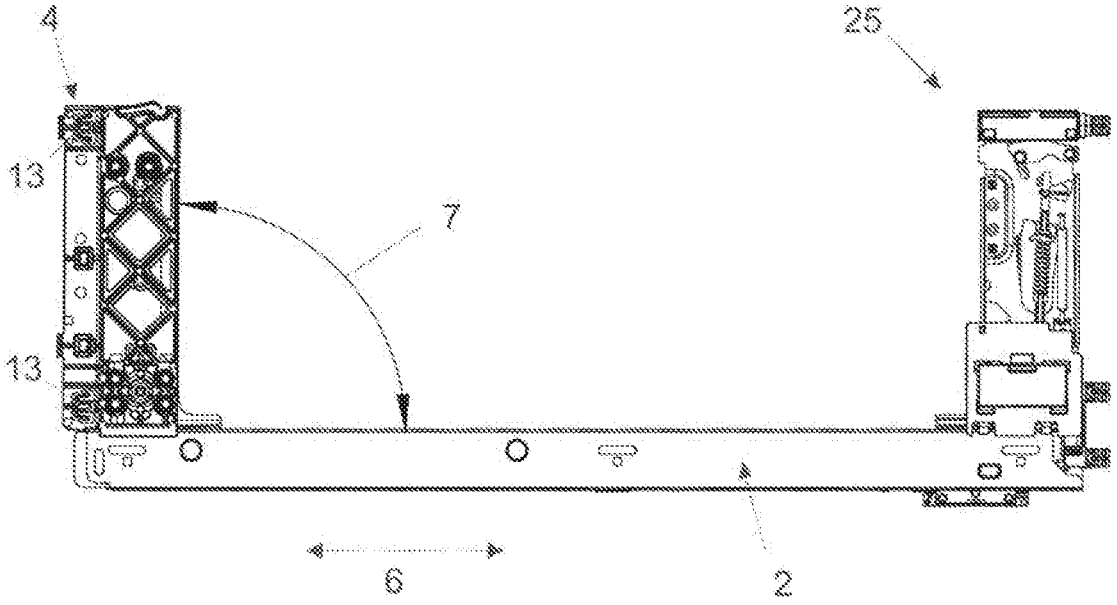
FIG. 3*b* shows the arrangement according to FIG. 3*a*, in which a holding device is additionally fixed to the carrier body.

In FIG. 3*b*, the arrangement previously described in connection with FIG. 3*a* is depicted, and a holding device 4 is additionally fixed to the carrier body 2, namely via the fastening device 16. The holding device 4, at least in the unfixed condition of the drawer rear wall 5, is inclinedly aligned to (is inclined relative to) the longitudinal direction 6 of the carrier body 2. More precisely, the holding device 4 has a first angle of approximately 89.5° to the longitudinal direction 6 of the carrier body 2.

Figure 4:
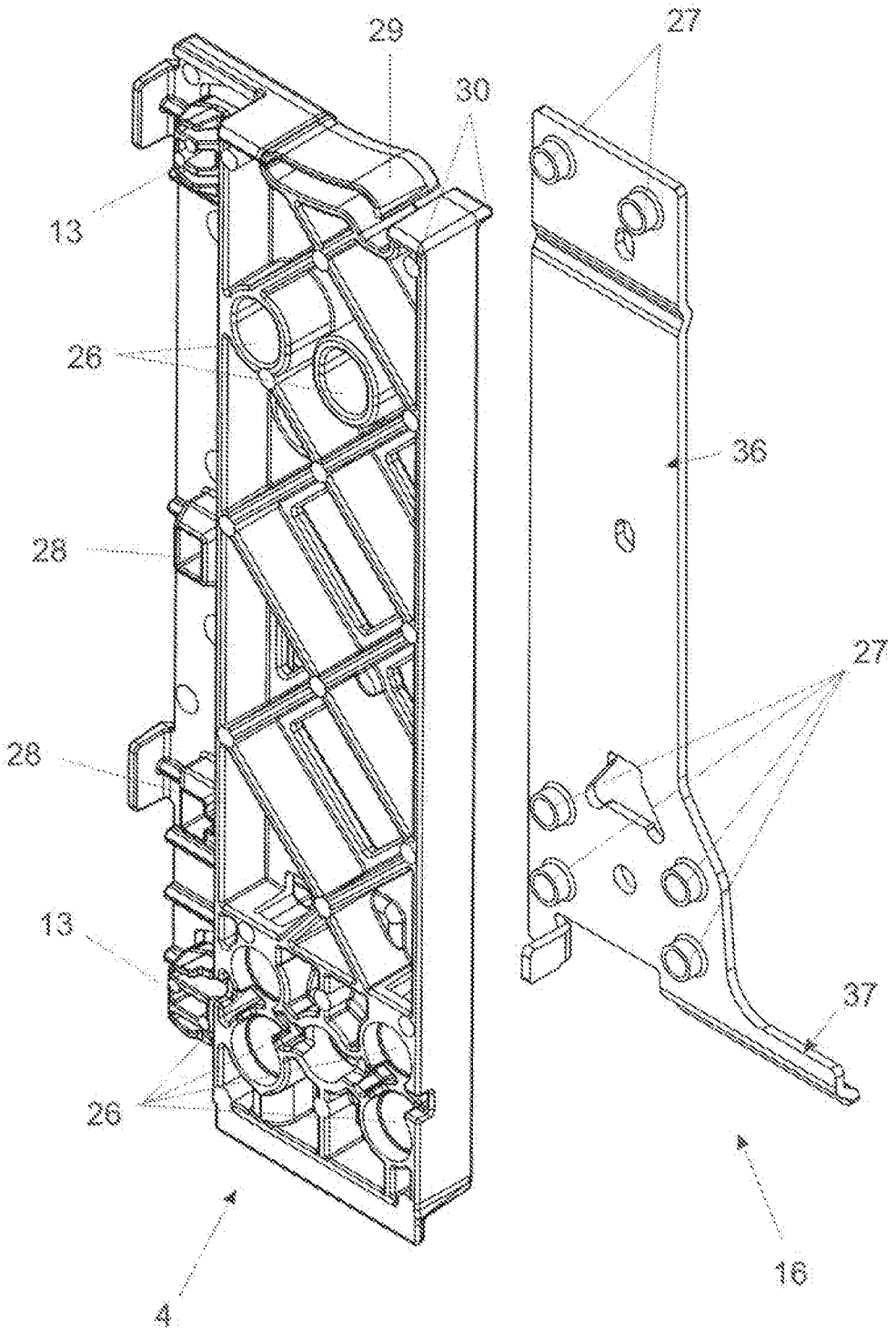
FIG. 4 is a perspective view of the holding device and the fastening device in an unconnected condition.

In FIG. 4, the holding device 4 and the fastening device 16 are depicted in an unconnected condition.

The fastening device 16 includes a fastening device interface 17 for connecting the holding device 4 to the fastening device 16, and the fastening device interface 17 includes six protrusions 27. The protrusions 27 can be configured, as in the depicted case, as embossments or as drawn neck portions.

The holding device 4 includes a holding device interface 15 for fastening to the carrier body 2, and the holding device interface 15 includes six openings 26. The openings 26 correspond in their shape to the form of the protrusions 27.

For fixing the holding device 4 to the carrier body 2 or to the fastening device 16, respectively, the protrusions 27 are introduced into the openings 26. Subsequently, a fixing can further be implemented, for example by tumbling or bonding.

It is to be noted that the kinematic reversal is also possible, namely that the protrusions are arranged on the holding device 4 and the openings are arranged on the fastening device 16.

The fastening device 16 includes a vertical limb 36 and a horizontal limb 37, and the fastening device interface 17 is arranged on the vertical limb 36. The fastening device 16 is fixed to the carrier body 2 via the horizontal limb 37.

On the holding device 4, two first portions 13 of a locking device for two second portions 14 of the locking device are arranged, the second portions 14 of the locking device being arranged on the drawer rear wall 5 and co-operating with the first portions 13. The first portions 13 include a latching pin. The second portions 14 may be in the form of corresponding recesses (see FIG. 6).

The holding device 4 further includes centering devices 28 which can be configured, for example, as pins and which help to align the drawer rear wall 5 relative to the holding device 4 in the course of fixing the drawer rear wall 5 to the holding device 4. The centering devices 28 can engage into corresponding openings 31 which can be arranged, for example, on a rear wall fitting 34 arranged on the drawer rear wall 5 (see FIG. 6).

The holding device 4 further includes a spring element 29 and guide elements 30 on which the sidewall profile 3 can be supported.

Figure 5:
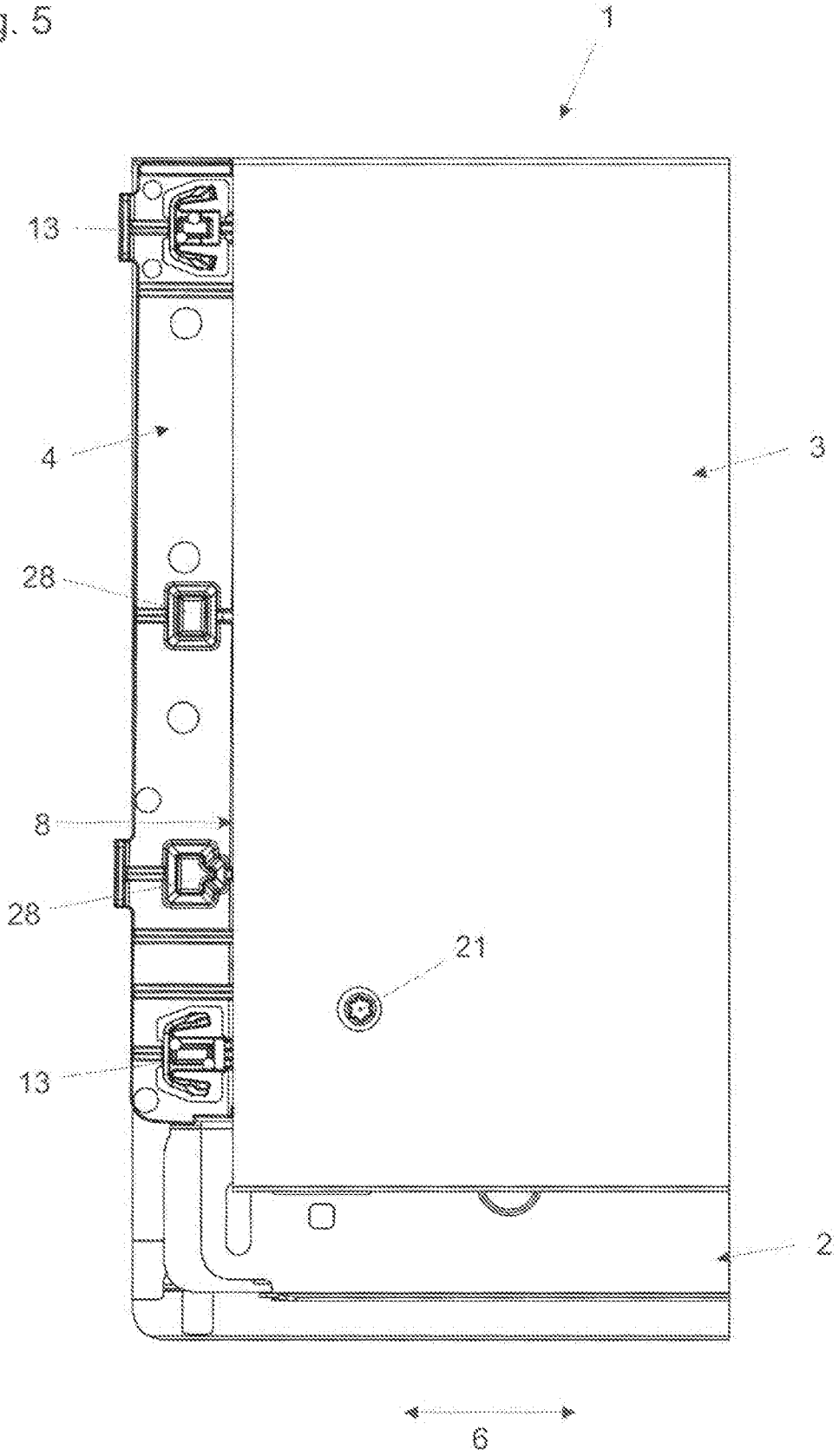
FIG. 5 shows a detail of the arrangement according to FIG. 3*b* in the region of the drawer rear wall, in which a sidewall profile is additionally arranged on the carrier body.

FIG. 5 shows a detail of the arrangement according to FIG. 3*b* in the region of the drawer rear wall 5, and a sidewall profile 3 is additionally arranged on the carrier body 2.

The holding device 4 is partially arranged within the sidewall profile 3.

It is further visible that the holding device 4 is not only inclinedly aligned to the carrier body 2, but also inclinedly aligned to the sidewall profile 3. This leads to the fact that the first portion 13 of the upper fastening location 12 has a smaller distance to (is closer to) the abutment portion 8 of the sidewall profile 3 than the first portion 13 of the lower fastening location 12.

Figure 6:
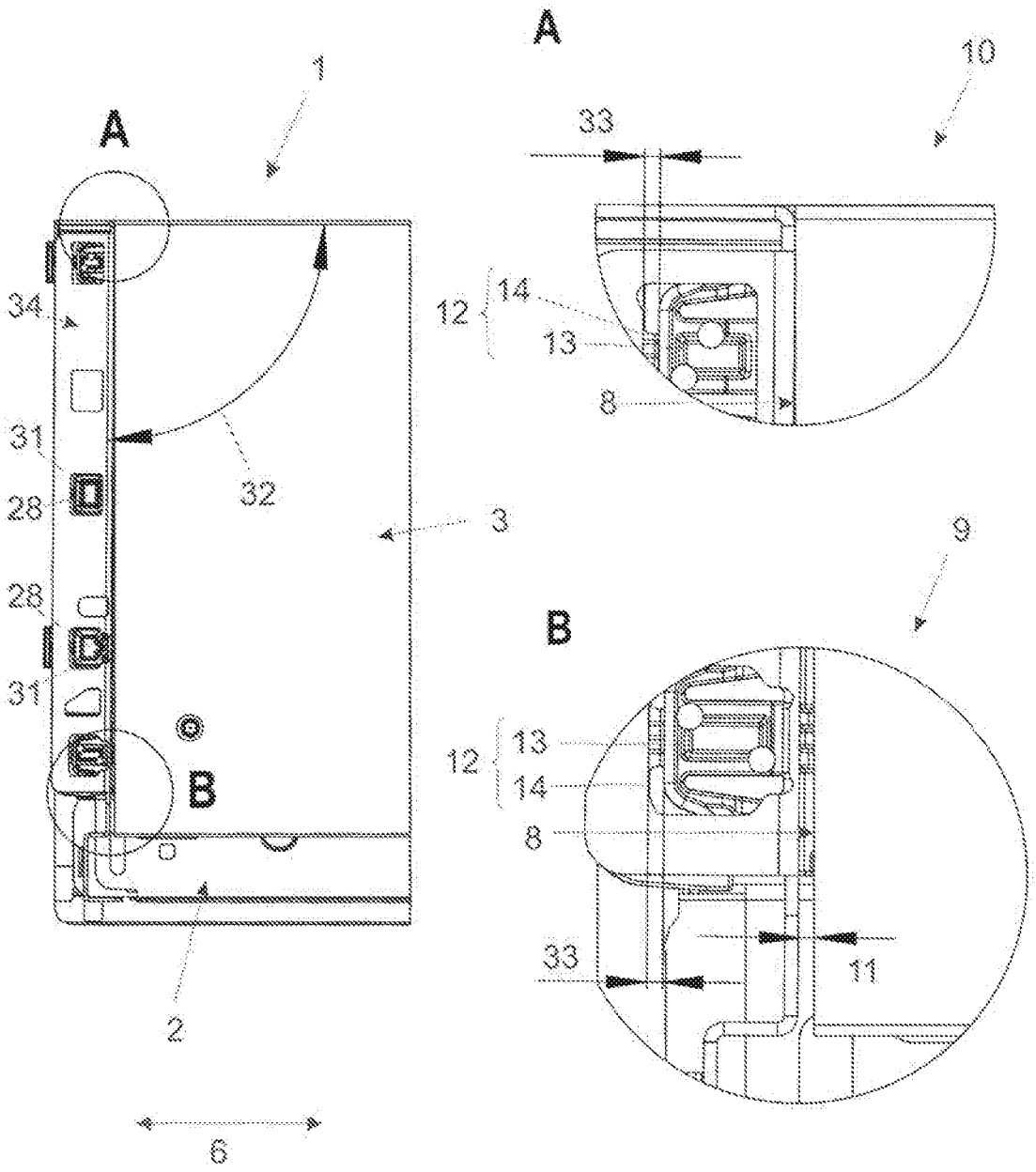
FIG. 6 shows the detail according to FIG. 5, in which a rear wall fitting of the drawer rear wall is additionally fixed to the holding device.

FIG. 6 shows the detail according to FIG. 5, in which a rear wall fitting 34 of the drawer rear wall 5 is additionally fixed to the holding device 4. The rear wall fitting 34 is firmly connected to the drawer rear wall 5 and is representatively depicted in FIG. 6 for the drawer rear wall 5.

The centering devices 28 engage into the openings 31. As can be seen in the enlarged detail views A and B, the first portions 13 engage into the second portions 14. Each of the two portions 13 and 14 jointly form a fastening location 12 for fixing the drawer rear wall 5 to the holding device 4.

As can be also seen in the enlarged detail views A and B, the drawer rear wall 5 or the rear wall fitting 34, respectively, is aligned parallel to the holding device 4. The distance 33 of the two portions 13 and 14 of the fastening locations 12 is namely identical.

The drawer rear wall 5 or the rear wall fitting 34, respectively, encloses an angle 32 to the upper edge of the sidewall profile 3, the angle 32 being larger than 90°, for example 90.5°.

As can be seen in the enlarged detail view A showing the upper region 10, the drawer rear wall 5 bears against the abutment portion 8 in this region. On the contrary, the drawer rear wall 5, in the lower region 9 illustrated in the enlarged detail view B, is spaced from the abutment portion 8 by a gap 11. In the ideal case, this gap 11 is not present.

The invention claimed is:

1. An arrangement comprising:

a drawer front panel;

a drawer sidewall; and a drawer rear wall, wherein the drawer sidewall includes:

a carrier body, a first fastening device on a rear region of the carrier body, a second fastening device on a front region of the carrier body, a sidewall profile, and a holding device for fastening the drawer sidewall to the drawer rear wall, the first fastening device fixing the holding device to the carrier body, wherein the sidewall profile is fixed to the carrier body, wherein the drawer rear wall is fixed to the holding device, wherein the second fastening device is fixed to the drawer front panel, wherein the holding device is fixed to the carrier body so as to be inclined relative to a longitudinal direction of the carrier body when unfixed and unconnected to the drawer rear wall, the holding device forming a first angle smaller than 90° relative to the longitudinal direction of the carrier body when unfixed and unconnected to the drawer rear wall, wherein the holding device is configured to form a second angle relative to the carrier body when fixed to the drawer rear wall, the second angle being larger than the first angle formed when the holding device is unfixed and unconnected to the drawer rear wall, and wherein the first angle is larger than 85°.

2. The arrangement according to claim 1, wherein the sidewall profile includes an abutment portion for supporting the drawer rear wall.

3. The arrangement according to claim 2, wherein the abutment portion is perpendicular to the longitudinal direction of the carrier body.

4. The arrangement according to claim 1, wherein the holding device comprises a plastic material.

5. The arrangement according to claim 1, further comprising a fastening location for releasably fastening the drawer rear wall to the holding device.

6. The arrangement according to claim 1, wherein the first fastening device forms an angle of 90° relative to the longitudinal direction of the carrier body, the first fastening device (i) being welded to the carrier body, (ii) comprising metallic material, and/or (iii) including a first fastening device interface for connecting the holding device to the first fastening device.

7. The arrangement according to claim 1, wherein the holding device is at least partially arranged within the sidewall profile.

8. The arrangement according to claim 2, wherein the first angle is approximately 89.5°.

9. The arrangement according to claim 2, wherein the abutment portion includes a first region and a second region, the first region being closer to the carrier body than the second region, the drawer rear wall bearing against the second region of the abutment portion when fixed to the holding device.

10. The arrangement according to claim 9, wherein the drawer rear wall is spaced from the first region by a gap.

11. The arrangement according to claim 3, wherein the abutment portion includes a first region and a second region, the first region being closer to the carrier body than the second region, the drawer rear wall bearing against the second region of the abutment portion when fixed to the holding device.

12. The arrangement according to claim 11, wherein the drawer rear wall is spaced from the first region by a gap.

13. The arrangement according to claim 4, wherein the holding device includes a holding device interface for fixing the holding device to the carrier body.

14. The arrangement according to claim 1, wherein the holding device includes a holding device interface for fixing the holding device to the carrier body.

15. The arrangement according to claim 5, wherein the fastening location includes a first portion of a locking device, the first portion of the locking device being arranged on the holding device and being configured to cooperate with a second portion of the locking device, the second portion of the locking device being arranged on the drawer rear wall.

16. The arrangement according to claim 1, wherein the holding device is inclined relative to a longitudinal direction of the carrier body within a plane of the drawer sidewall.

17. An arrangement comprising: a drawer front panel;

a drawer sidewall; and a drawer rear wall, wherein the drawer sidewall includes:

a carrier body, a first fastening device on a rear region of the carrier body, a second fastening device on a front region of the carrier body, a sidewall profile, and a holding device for fastening the drawer sidewall to the drawer rear wall, the first fastening device fixing the holding device to the carrier body, wherein the sidewall profile is fixed to the carrier body, wherein the drawer rear wall is fixed to the holding device, wherein the second fastening device is fixed to the drawer front panel, wherein the holding device is fixed to the carrier body so as to be inclined relative to a longitudinal direction of the carrier body when unfixed and unconnected to the drawer rear wall, the holding device forming a first angle smaller than 90° relative to the longitudinal direction of the carrier body when unfixed and unconnected to the drawer rear wall, wherein the holding device is configured to form a second angle relative to the carrier body when fixed to the drawer rear wall, the second angle being larger than the first angle formed when the holding device is unfixed and unconnected to the drawer rear wall, wherein the holding device has an abutment portion for bearing against the drawer rear wall when the holding device is fixed to the drawer rear wall, and wherein the first angle is larger than 85°.

* * * * *